US008458916B2

(12) United States Patent
Aplin et al.

(10) Patent No.: US 8,458,916 B2
(45) Date of Patent: Jun. 11, 2013

(54) STRAIGHT EDGE CIRCLE TOOL

(76) Inventors: Philip Cyril Aplin, Volcano, HI (US); Peter Kummli, Auburn, CA (US)

( * ) Notice: Subject to any disclaimer, the term of this patent is extended or adjusted under 35 U.S.C. 154(b) by 0 days.

(21) Appl. No.: 13/134,244

(22) Filed: Jun. 1, 2011

(65) Prior Publication Data

US 2011/0296700 A1 Dec. 8, 2011

Related U.S. Application Data

(60) Provisional application No. 61/396,811, filed on Jun. 2, 2010.

(51) Int. Cl.
*B43L 9/04* (2006.01)

(52) U.S. Cl.
USPC ..... 33/27.032; 33/485

(58) Field of Classification Search
USPC ..... 33/27.02, 27.03, 27.031, 27.032, 33/27.033, 484, 485, 486
See application file for complete search history.

(56) References Cited

U.S. PATENT DOCUMENTS

| | | | | | |
|---|---|---|---|---|---|
| 463,212 | A | * | 11/1891 | Fowler | 33/485 |
| 1,808,705 | A | * | 6/1931 | Owen, Jr. | 33/27.03 |
| 2,031,920 | A | * | 2/1936 | Benshimol | 33/27.03 |
| 2,651,843 | A | * | 9/1953 | Goodford | 33/27.03 |
| 2,983,048 | A | * | 5/1961 | Keller | 33/27.03 |
| 3,263,334 | A | * | 8/1966 | Mutter | 33/27.03 |
| 3,791,036 | A | * | 2/1974 | Stober et al. | 33/27.03 |
| 4,267,638 | A | * | 5/1981 | Heinz | 33/27.03 |
| 5,426,859 | A | * | 6/1995 | Concari et al. | 33/27.02 |
| 5,615,485 | A | * | 4/1997 | Stoneberg | 33/27.03 |
| 2003/0208918 | A1 | * | 11/2003 | Burke | 33/484 |
| 2010/0083514 | A1 | * | 4/2010 | Williams | 33/27.02 |

* cited by examiner

*Primary Examiner* — G Bradley Bennett
(74) *Attorney, Agent, or Firm* — Heisler & Associates

(57) ABSTRACT

The tool is formed of an elongate rigid bar having a pair of straight side edges extending between opposite ends. Indicia are provided adjacent graduations correlating with distances away from center holes located at each end of the bar. A series of marking holes are provided at various distances away from the center holes. Thus, when a pin is provided through one center hole, a marking tool can be placed within a marking hole having a distance corresponding with a radius of a curve to be formed, and the bar can be rotated about the pin in the center hole while the marker is allowed to form a mark in an underlying workpiece. The straight edges of the tool can also be utilized for forming straight edges.

29 Claims, 4 Drawing Sheets

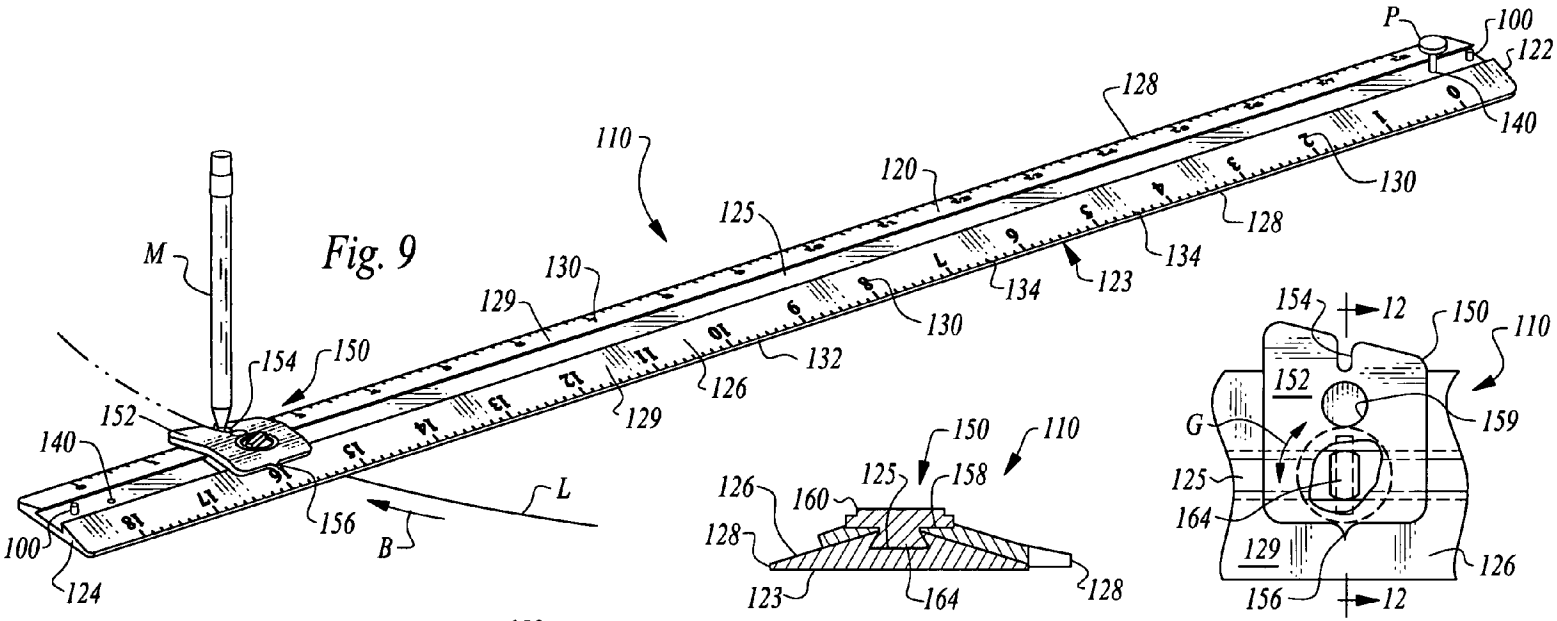
Fig. 9
Fig. 11
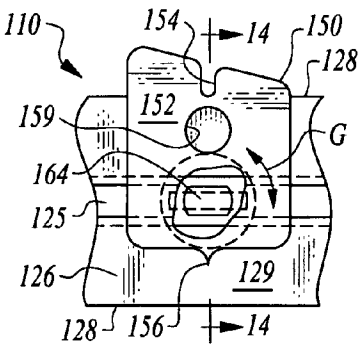
Fig. 13
Fig. 12
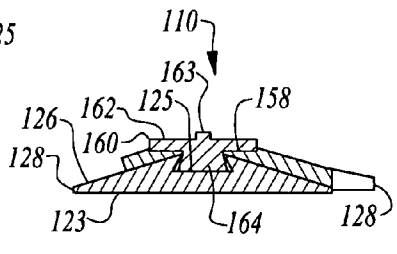
Fig. 14
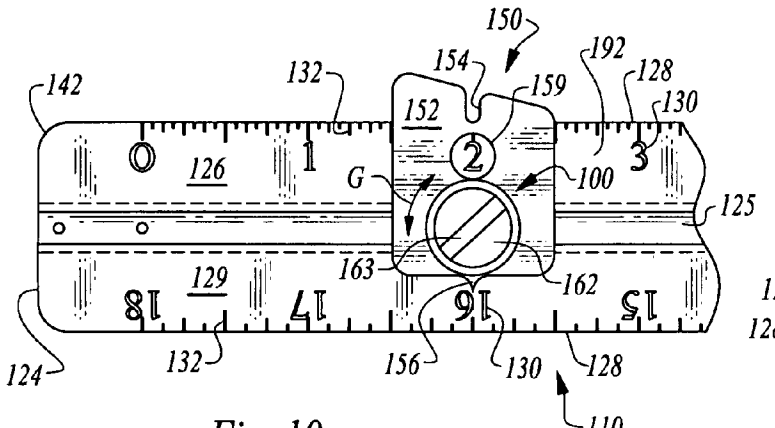
Fig. 10

STRAIGHT EDGE CIRCLE TOOL

CROSS-REFERENCE TO RELATED APPLICATIONS

This application claims benefit under Title 35, United States Code §119(e) of U.S. Provisional Application No. 61/396,811 filed on Jun. 2, 2010.

FIELD OF THE INVENTION

The following invention relates to construction tools for forming curves and straight edges. More particularly, this invention relates to construction tools which can mark a workpiece along a curve segment for forming a curve in the workpiece.

BACKGROUND OF THE INVENTION

When practicing the construction arts it is often necessary to mark out lines along which different actions are required to be made. For instance, when a large piece of sheet material (i.e. plywood or oriented strand board (OSB)) is to be cut in a particular fashion. When the lines are straight, some form of straight edge tool is typically utilized as is known in the art. When curves are required to be drawn, a compass can be used if the curve is circular and relatively short. However, when larger curves need to be formed on a piece of material before it is cut, more difficulty is experienced. Also, when laying out forms, such as for concrete pouring and when building landscaping hardscape elements, when a larger curve needs to be laid out during a construction process, it can be difficult to form precise curves.

Construction tools need to be simple to use or their propensity for non-use or misuse is sufficiently great that the tool loses its usefulness. Hence, it is important that any curve/circle marking tool be easy to utilize. Also, beneficially the tool would benefit from being usable for other purposes, such as also performing as a straight edge, so that it becomes a multi-use tool.

SUMMARY OF THE INVENTION

With this invention a straight edge tool is provided which can also be used for precisely forming circles or portions of circles. The tool is generally in the form of an elongate rigid structure, such as formed of a metal (typically aluminum or steel), but conceivably also formable from relatively high strength plastic or other material. The tool beneficially has straight edges so that it can double as a straight edge tool. A plurality of graduation marks are provided at various different distances along opposite straight long side edges of the tool. Indicia are provided adjacent some of these graduation marks providing an indication of the significance of some of the marks. For instance, in a preferred embodiment some of the graduation marks are at one inch increments away from a starting point, and numbers for whole inches act as the indicia and are provided adjacent such graduation marks.

To facilitate usefulness of the tool in forming circular arcuate lines, a series of holes are provided passing through the tool. A first large hole is provided merely as a suspension aide to allow the tool to be easily hung from a nail or other hanger on a wall. This hole is typically rather large and not sufficiently precise to serve any function during the forming of curves. Other holes are also provided through the tool. One of these holes is provided at each extreme end lined up with a zero point on the tool so that either end can be the pivot point.

This zero point is typically inboard from each end somewhat to ensure that the hole has sufficient material around it so that it can maintain its form and not break out of an end of the tool. In one embodiment a radius of approximately one inch is provided at each end of the tool to provide strength about this starting hole.

This starting hole is fitted with a nail or other pivot element which would be fixed in position at a center of the circle or circular arc. The nail, pin or other pivot element would preferably be approximately the same size as the hole so that accurate measurements can be provided, but which has sufficient clearance so that the entire tool can be pivoted about this first hole when mounted upon such a nail or other pivot pin.

Furthermore, additional holes are preferably provided spaced away from the pivot hole. These additional holes are provided at standard distances. A pencil or other marker can thus pass through an appropriate hole and then be simultaneously used to mark an underlying surface. As the tool is rotated about the pivot point, the pencil passing through the hole a desired distance away fro the pivot point can mark a curving line on a material to be cut. The holes are preferably provided at rather frequent distances, such as one-eighth inch distances or one-quarter inch distances from each other.

These holes are sufficiently large and sufficiently frequent that aligning them along a single line radiating from the pivot hole would weaken the tool along that line. Hence, these holes are offset from a centerline for non-primary length increments, such as quarter inch increments and along the centerline for one inch increments. The lateral offset holes are sufficiently far from the pivot hole that this offset does not make any significant change in the distance from the pivot hole.

In addition to use of the tool in cutting materials during construction, the tool can also be utilized in landscaping. For instance, when a wall is to be formed that has a perfect circular form, or for laying out form boards for a circular concrete patio, the tool of this invention can be effectively utilized for forming such a curve during such form building or other landscaping procedures. In particular, a pivot pin, which could be in the form of a stake pounded into the ground with a small nail on an upper end thereof, can be provided with the nail passing through the pivot hole. Then as edging material is being placed the tool can remain in position and be frequently utilized to make sure that form materials are properly being positioned a constant distance away from this pivot point, as measured by the tool freely rotating away from this pivot point.

OBJECTS OF THE INVENTION

Accordingly, a primary object of the present invention is to provide a tool for forming circles and circle segments in construction of structures as part of a building, landscaping or other structure.

Another object of the present invention is to provide a marking tool which can facilitate marking of both a straight edge line and curving line segments.

Another object of the present invention is to provide a marking tool which is easy to use and performs precise marking, especially of curves.

Another object of the present invention is to provide a marking tool which can be effectively used in more than one orientation.

Another object of the present invention is to provide a marking tool and method which simplifies the process of forming precise curves in construction.

Another object of the present invention is to provide a method for forming arcs of various different sizes.

Another object of the present invention is to provide a tool for forming curves and straight edges which is of rigid form and can be readily made from relatively low cost materials, such as by stamping or extrusion.

Another object of the present invention is to provide a method for forming triangles and bisecting lines and performing other geometric calculations over greater distances than can typically be achieved with a compass.

Other further objects of the present invention will become apparent from a careful reading of the included drawing figures, the claims and detailed description of the invention.

BRIEF DESCRIPTION OF THE DRAWINGS

FIG. 9 is a perspective view of an alternative tool having a sliding shuttle holding a marker thereon at a position spaced from a pivot pin or other pivot element.

FIG. 10 is a top plan view of a portion of that which is shown in FIG. 9.

FIG. 11 is a top plan view of a detail of that which is shown in FIG. 10 and with hidden portions shown in broken lines and with a portion of a locking disk cut away to reveal interior details.

FIG. 12 is a full sectional view taken along line 12-12 of FIG. 11 and revealing interior details of the tool of FIGS. 9 and 10.

FIG. 13 is a top plan view similar to that which is shown in FIG. 11 but with a locking knob rotated to an unlocked position.

FIG. 14 is a full sectional view of the tool taken along lines 14-14 of FIG. 13 and illustrating the locking knob when in an unlocked orientation and allowed to move freely along the elongate groove.

DESCRIPTION OF THE PREFERRED EMBODIMENT

Figure 1:
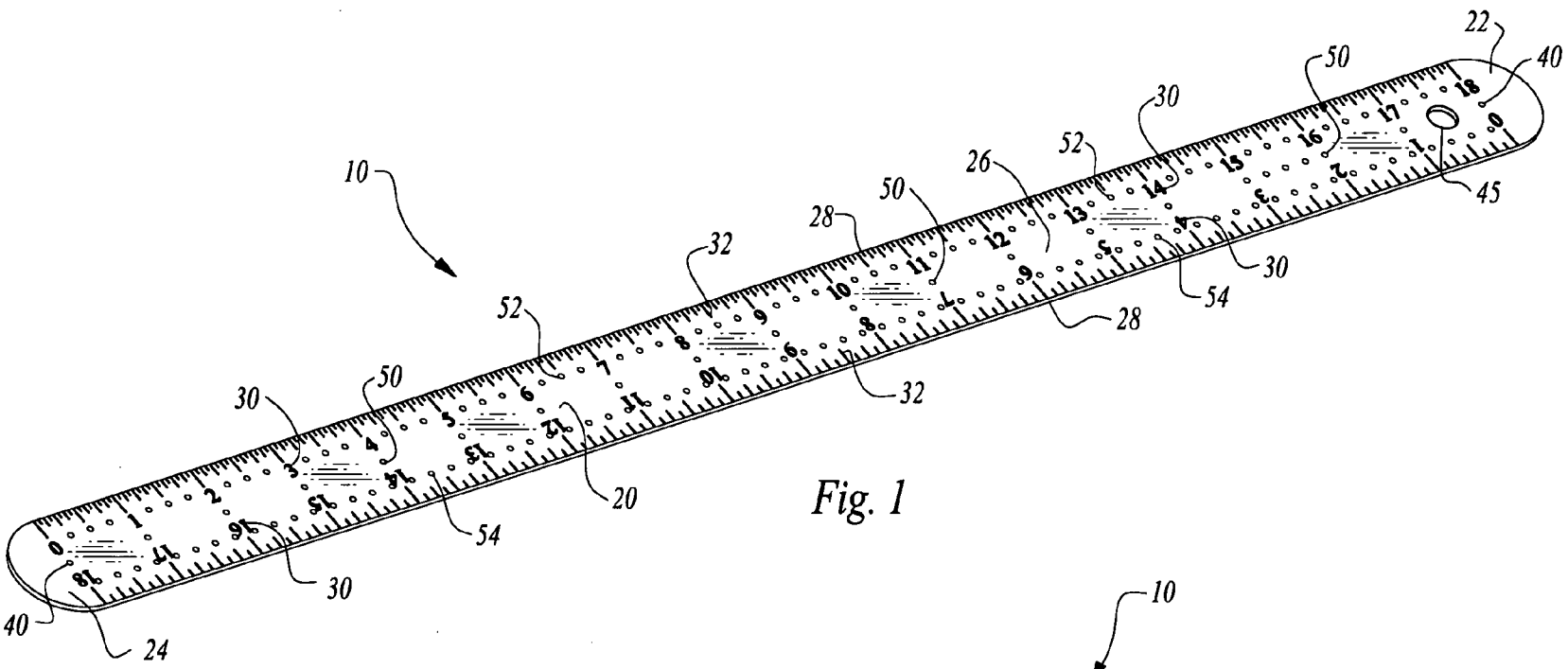
FIG. 1 is a perspective view of a tool according to a preferred embodiment of this invention and illustrating one typical size for this invention.

Referring to the drawings, wherein like reference numerals represent like parts throughout the various drawing figures, reference numeral 10 is directed to a tool for use in forming a line L (FIGS. 3-5) having a curving contour or a line L which is straight. The tool 10 can be used to form curving lines L having a variety of different distances from an origin O point (FIG. 5) such as for use in forming curving structures within a building or landscape.

Figure 2:
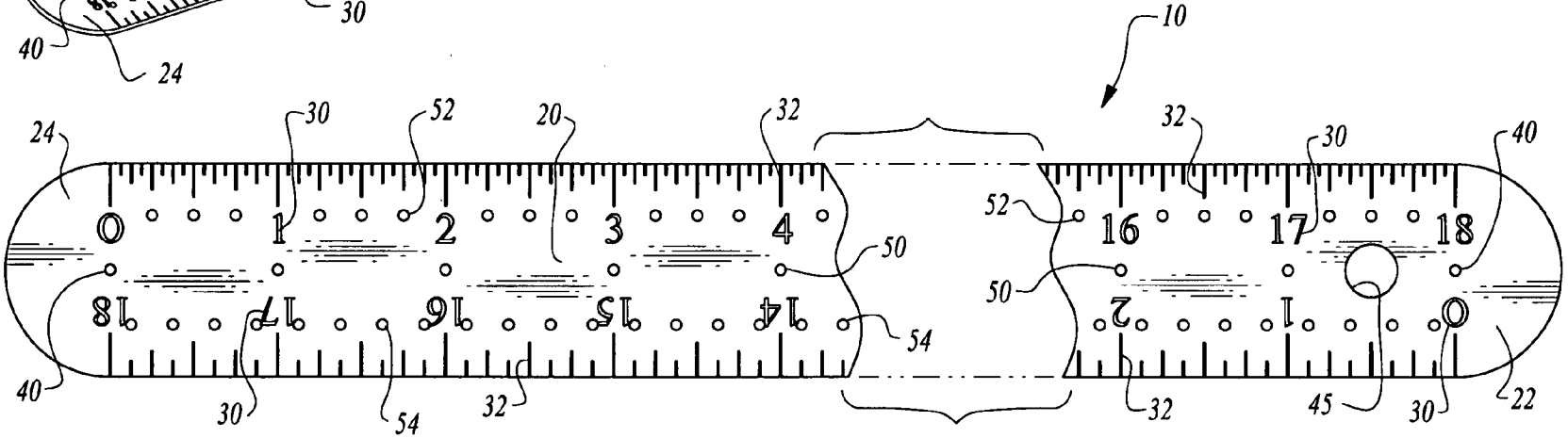
FIG. 2 is a top plan view of that which is shown in FIG. 1 and with mid-portions thereof cut away to reveal additional details of the tool of this invention.

In essence, and with particular reference to FIGS. 1 and 2, basic details of the tool 10 of this invention are described as exhibited in a preferred embodiment. In this embodiment, an eighteen inch tool 10 is depicted, while tools having greater (or lesser) lengths could also be provided. The tool 10 is formed of an elongate rigid bar 20 with straight side edges 28 extending between opposite ends 22, 24. Indicia 30, typically in the form of numbers, are provided on the bar 20, indicative of a distance from a center hole 40 at each end. Graduations 32 typically in the form of lines, are also provided at regular intervals and generally extending perpendicularly to the side edges 28.

Figure 3:
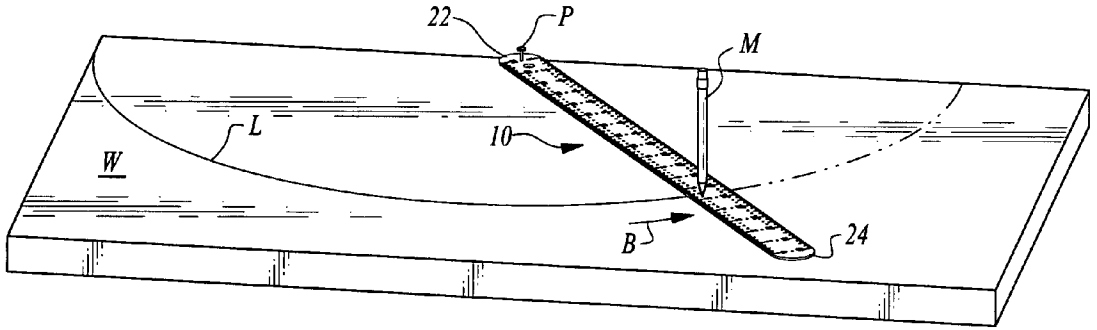
FIG. 3 is a perspective view of one tool used according to a method of this invention to form a semi-circle in a workpiece to be cut or otherwise altered along a curving line.
Figure 4:
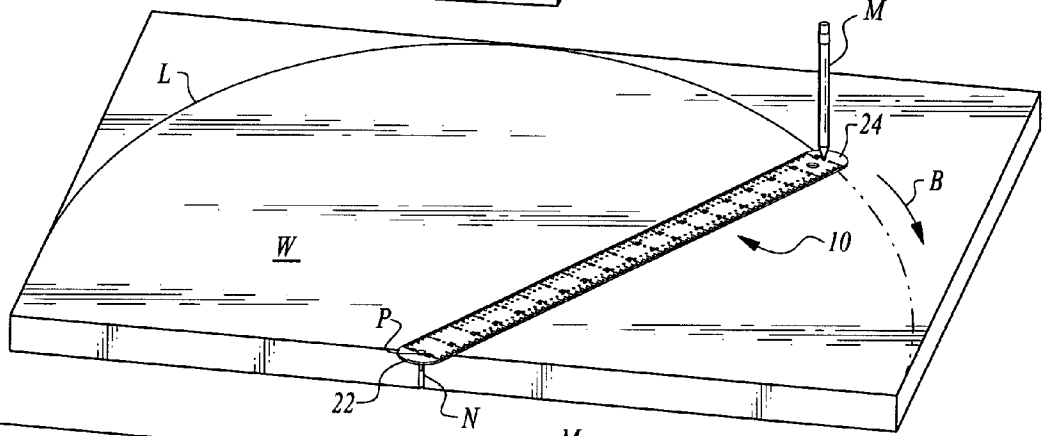
FIG. 4 is a perspective view similar to that which is shown in FIG. 3 but from an opposite perspective.
Figure 5:
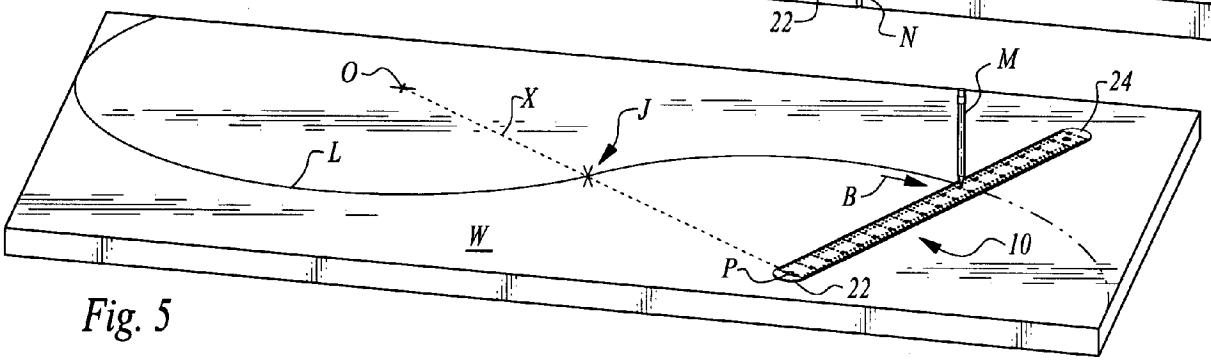
FIG. 5 is a perspective view of a tool according to one form of this invention used to form a pair of curves that come together at a junction.

A center hole 40 is provided at least one end and typically at each end corresponding with a "zero" indicia 30. This center hole 40 is adapted to receive a pivot element therethrough, such as a pin or nail. A series of marking holes are provided spaced from the central hole 40 at regular distances away from the center hole 40. These marking holes include primary marking holes 50 provided at one inch spacing, secondary marking holes 52 provided at quarter inch spacing and tertiary marking holes 54 provided at one-eighth inch intervals. These holes 50, 52, 54 are sized just large enough to allow a tip of a marker M to pass therethrough to mark an underlying workpiece W or other structure to form a line L thereon (FIGS. 3-5). FIG. 9 depicts one alternative embodiment where a plurality of marking holes are replaced with a shuttle which slides along a groove and includes a notch or other marker support thereon which can slide to a desired position and then be locked in place for use in a manner similar to the tool 10 (FIGS. 1 and 2).

Figure 7:
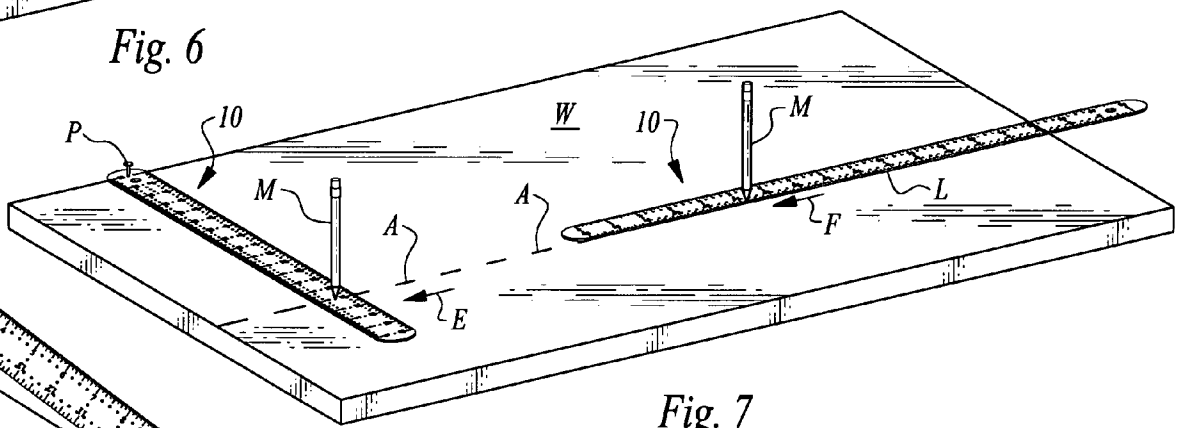
FIG. 7 is a perspective view similar to that which is shown in FIG. 6 but illustrating a secondary method when the tool is used to form a straight line at a particular location on a workpiece.

More specifically, and with continuing reference to FIGS. 1 and 2, specific details of the bar 20 forming the tool 10 are described. The bar 20 is an elongate rigid structure, preferably formed from a single unitary mass of rigid material, such as aluminum, steel, or a plastic or other hydrocarbon material having stiffness characteristics generally similar to aluminum or steel. The bar 20 preferably has a constant width between opposite side edges 28. These two side edges 28 are straight to facilitate the marking of straight lines L by running a marker M along a side edge 28 (such as along arrow F of FIG. 7).

The bar 20 preferably has a top surface 26 opposite a parallel underlying bottom surface. This top surface 26 is planar and supports indicia 30 and graduations 32 thereon. Optionally, the bottom surface opposite the top surface 26 can also be provided with indicia 30 and/or graduations 32. A thickness of the bar 20 is preferably constant and in one embodiment is approximately one-sixteenth of an inch thick.

The bar 20 has an elongate form extending from an inner end 22 to an outer end 24. These two ends 22, 24 define opposite extreme ends of the bar 20 which cause the bar 20 to be elongate in form in that the bar 20 is longer between ends 22, 24 than a width between two side edges 28. While the inner end 22 and outer end 24 are so named, preferably each end 22, 24 has a center hole 40 adjacent thereto so that the bar 20 is generally reversible and either end can be positioned at an "inner" portion of a circle while the opposite "outer" portion of the bar 20 passes over an outline of a circular arc being formed by the tool 10.

With continuing reference to FIGS. 1 and 2, details of markings placed on the bar 20 are described, according to a preferred embodiment. While the bar 20 could be plain on its surface, most preferably printed material or other visually perceptible markings are provided on the top surface 26 of the bar 20 (and optionally also on the bottom surface of the bar 20). These markings come in at least two varieties including indicia 30 and graduations 32. The indicia 30 are preferably in the form of numbers. In a most preferred form of the invention the indicia 30 are whole integers starting at zero and then spaced approximately one inch from each other extending away from the center holes 40 located adjacent each end of the bar 20.

Preferably two indicia 30 are located at each one inch interval which face in opposite directions to be read from opposite sides of the tool, with one set of indicia 30 counting up from the inner end 22 and the other set of indicia 30 counting down from the inner end 22. In this eighteen inch embodiment, nineteen sets of indicia are provided extending from integers zero to eighteen. The overall bar is preferably configured to have a rounded terminus at each end 22, 24 that has an approximately one inch diameter, such that the overall marking tool has a length of about nineteen inches. While the indicia 30 generally corresponds with the English measuring system, based on inches, as an alternative metric units might be provided, such as with indicia corresponding with centimeters.

The graduations 32 are preferably in the form of linear marks oriented perpendicular to the side edges 28. Preferably these graduations 32 come in a variety of different lengths with the longest graduations 32 corresponding with whole inches away from the center holes 40 and the number of which whole integers away from the center holes 40 corresponding with the number of the indicia 30 located adjacent these longest graduations 32. Preferably, the second longest graduations correspond with half inch marks midway between the longest graduations 32. Quarter inch marks can be provided between the half inch and whole inch marks. Eighth inch marks can be provided between the quarter inch marks and half inch or one inch marks. Preferably, at least one of the side edges 28 has graduations 32 which further continue to have sixteenth inch graduation marks thereon which would be the shortest graduation marks in a typical embodiment (although thirty-two inch increment marks might also be provided as additional fine graduations 32).

Preferably, these graduations 32 follow a somewhat standard prior art pattern which facilitates the ready determination of the distance value associated with each graduation even though indicia are only provided adjacent the one inch intervals, rather than adjacent the graduations 32.

These indicia 30 and graduations 32 can optionally be provided not only on the top surface 26 but also on a bottom surface opposite the top surface 26. The graduations 32 could be provided by forming small grooves or scratches in the bar 20, but most preferably are printed precisely onto the bar 20 at the required positions relative to the central holes 40 adjacent each end 22, 24 of the bar 20. While the indicia 30 are preferably in the form of numbers and the graduations 32 are preferably in the form of lines, it is conceivable that the indicia 32 could be in the form of letters or other markings. Similarly, the graduations could be in the form of arrows or other non-line substitutes.

With continuing reference to FIGS. 1 and 2, details of the holes formed in the bar 20 are described, according to this exemplary embodiment. In the tool 10 of this embodiment, the bar 20 has a plurality of holes passing therethrough. Central holes 40 are provided at least one end 22, 24 of the tool 10, most preferably with one at each end 22, 24. These center holes 40 are aligned with indicia "0" and the first graduation 32 adjacent this first indicia 30. Thus, when a pin P such as a nail is placed at an origin O of a circle or other arc to be formed, the tool T can pivot about this origin O while supported through the center hole 40, and other portions of the tool are passed along arcs at distances away from the origin O corresponding with the indicia 30 and graduations adjacent thereto.

These center holes 40 are preferably approximately one-sixteenth of an inch in size, or slightly larger, such as three-thirty-seconds of an inch in diameter. The holes are provided with a center point of the hole aligned with the graduation associated with the indicia "0" adjacent each end.

A suspension hole 45 is preferably located adjacent at least one of the two ends. This suspension hole 45 is a significantly larger hole which can be readily place onto a hanging structure extending from a wall, so that the tool 10 can be conveniently hung from a wall structure rather than on the ground where it risks becoming bent or otherwise damaged.

In addition to the central holes 40, a plurality of marking holes 50, 52, 54 are provided at various distances away from the center hole 40. These marking holes can be divided into three groups including primary marking holes 50, secondary marking holes 52 and tertiary marking holes 54. Primary marking holes 50 are provided at one inch intervals. Furthermore, the primary holes 50 are preferably provided along a center line midway between the two side edges 28. These primary marking holes 50 would be used by a marker M when a circular arc is being formed which has a radius that measures in a whole integer.

The secondary marking holes 52 are preferably not provided in line with the primary marking holes 50 so that strength of the bar 20 is not compromised by providing too many holes along a common line. Rather, the secondary marking holes 52 are preferably provided at a point approximately midway between a centerline of the bar 20 and one of the side edges 28. Because the primary marking holes 50 are already provided at one inch intervals, the secondary marking holes 52 are limited to quarter inch intervals but omitting intervals which correspond with whole inch distances away from the center hole 40. For instance, secondary marking holes 52 would first be provided one quarter of an inch from the center hole, then at one-half inch from the center hole 40, then at three-quarters of an inch from the center hole 40. No secondary marking hole 50 would be provided one inch away from the center hole 40. Rather, the next secondary marking hole 52 would be at the one and one-quarter inch distance from the center hole 40.

The tool 10 would typically not be utilized for small circles or arcs (i.e. radiuses of two inches or less). However, it is desirable to have the holes extend all of the way to each end so that they are available when the center hole 40 of the opposite end 24, 22 of the bar 20 is being utilized for a center of the circle or curving arc. The gap in the secondary marking holes 52 adjacent each whole inch distance from the center hole 40 provides a convenient location for printing of the indicia 30 without having the printing of the indicia 30 overlap or otherwise interfere with the secondary marking holes 52.

Tertiary marking holes 54 are also provided, typically at a location spaced from the centerline of the bar 20 to avoid weakening the bar 20 along the centerline. Rather, the tertiary marking holes 54 are preferably provided along a line approximately midway between the centerline associated with the primary marking holes 50 and a second side edge 28 opposite the side edge which has the secondary marking holes 52 adjacent thereto. Tertiary marking holes 54 are preferably provided at one-eighth inch intervals, but omitting whole inch intervals and quarter inch intervals which are already being provided by the primary marking holes 50 and secondary marking holes 52. In this way, excessive numbers of tertiary marking holes 54 and associated weakness of the bar 20 is avoided.

In particular, the tertiary marking holes 54 would start with a hole one-eighth inch from the center hole 40. A next tertiary marking hole 54 would be at three-eighth inch spacing. A next tertiary marking hole 54 would be provided at the five-eighth inch spacing, followed by a hole at the seven-eighth inch spacing. The next tertiary marking hole 54 would be at the one and one-eighth inch interval.

As can be seen, with this arrangement of secondary marking holes 52 and tertiary marking holes 54, three secondary marking holes 52 are provided between each primary marking hole 50 and four tertiary marking holes 54 are provided between each primary marking hole 50. By spacing out these marking holes and sub-grouping them into those which have quarter inch or eighth inch spacing, strength of the bar 20 is maximized while also providing a convenient way for a user to quickly identify which hole 50, 52, 54 is to be used for the marker M.

In use and operation, and with particular reference to FIGS. 3-5, details of the invention's use, and particularly in conjunction with the use of the tool 10 described above, are explained for use in forming circles or circular arcs according to this invention. When a circular or circular arc is to be formed, a user first identifies a center point, also called an origin O, or a center of the circle or circular arc to be formed. A pin P, such as a nail is provided at this origin O. This pin P, nail or other pivot element passes through the center hole 40 and pivotably anchors the inner end 22 of the bar 20 adjacent the origin O.

The user then identifies the radius for the curve and other parameters of the curve such as the starting and stopping points for the curve to be formed. In the illustration shown in FIG. 3 a half circle is being formed in a workpiece W of planar construction sheet material. The user selects the graduations 32 and indicia 30 which correspond with the desired radius to identify the hole 50, 52, 54 adjacent thereto which should receive the marker M.

A tip of the marker M is then placed into this appropriate hole matching the desired radius for the line L. Finally, the bar 20 can be pivoted about the pin P (along arrow B) to form the line L on the workpiece W. As can be seen in FIG. 4, when a half circle is being formed in the workpiece W, it may be beneficial to provide a notch N at the origin of the arc so that the pin P can generally remain in place during the forming of the line L.

When curves are to be joined, initially a line between two origins can be identified and joined, such as with a straightedge making a slight mark on the material (such as depicted by line X of FIG. 5). A point therebetween which corresponds with the radii desired for each curve is defined as a junction J. A mark can also be made at this junction. The tool 10 can then be utilized to form arcs after the marker M has been placed in a hole corresponding with the radius to form each portion of the curve and the tool 10 has been allowed to pivot about the center hole 40 placed at each origin O, so that the marker M can form the line L segment desired.

Figure 6:
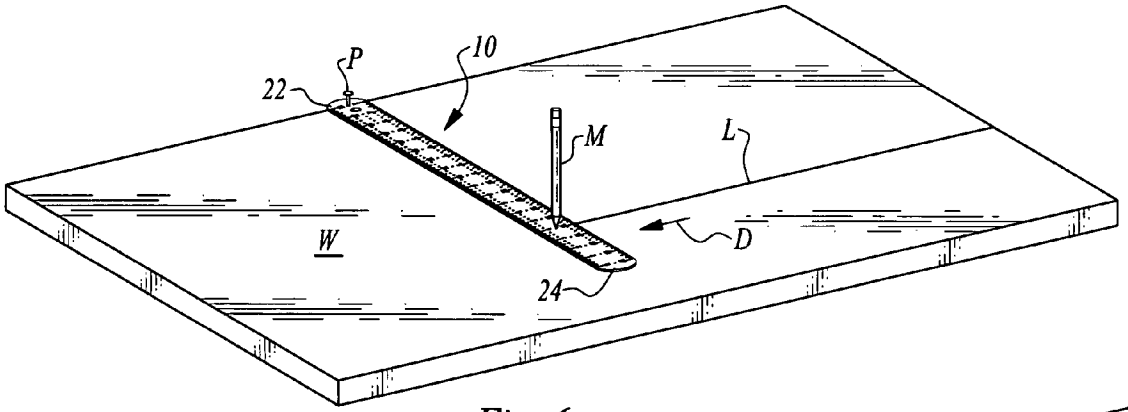
FIG. 6 is a perspective view of a tool according to one form of this invention used according to a method for forming a straight line upon a piece of material having a straight edge thereon already.

Various different straightedges are also facilitated by the tool 10. In an embodiment depicted in FIG. 6, a workpiece W can be marked along a line L parallel with an edge by running the pin P along the straight edge and along the marker M to form the line L by movement of the tool along arrow D. As another alternative, and when the workpiece W is too large to facilitate the method of FIG. 6, the tool 10 can be used repeatedly to form a series of marks (arrow E of FIG. 7) which can then be joined together to form the line L, such as by placing the tool 10 along these marks A and then drawing a line L (along arrow F of FIG. 7) to join the marks together.

Figure 8:
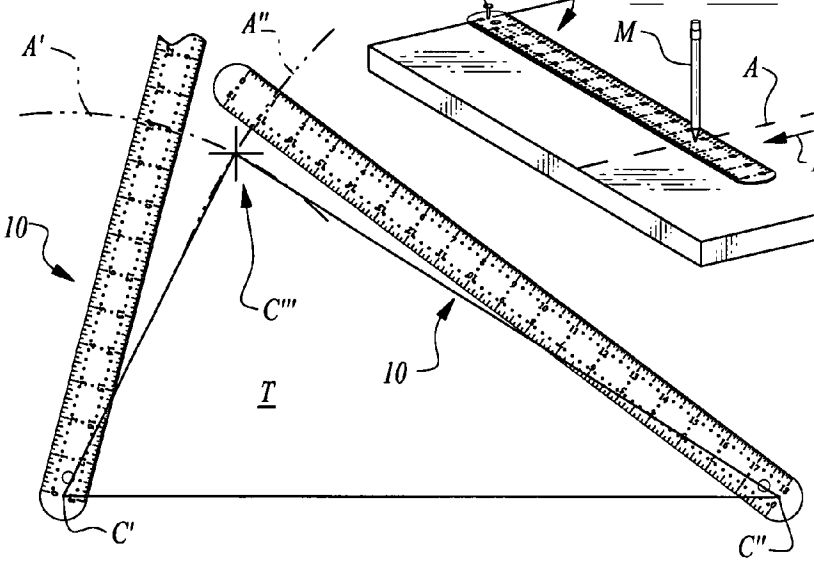
FIG. 8 is a top plan partial schematic view of a tool according to one form of this invention used in the process of forming a triangular structure.

When a triangle is to be formed (FIG. 8) typically lengths of the sides of the triangle T are known, but not angles. Two known points are identified and spaced apart, known as corners C' and C". Distances from corners C' to corners C"' are known and distances from corner C" and C"' are known. The tool 10 can be utilized to form arcs of these associated distances away from the corners C' and the corners C". Where the two arcs intersect is the location of the third corner C"'. These arcs A' and A" can be formed utilizing the tool 10 by placement of a marker M through the appropriate hole having the required spacing from the center hole 40.

Similarly, the tool 10 could also be utilized for other layout techniques such as dividing a line or forming other complex shapes such as pentagons, utilizing known geometric techniques that involve a compass and/or straightedge. Not only can the tool 10 perform these functions, but it performs these functions quickly and reliably with a simple tool. The marker M would typically be a pencil, but could be an ink pen or other form of marker (i.e. chalk, etc.).

With particular reference to FIGS. 9-14, details of an alternative tool 110 are described, according to an alternative embodiment of this invention. With the alternative tool 110, an elongate rigid bar 120 is provided which has a contour slightly different than the bar 20 of the previous embodiment. In particular, the bar 120 has an inner end 122 opposite an outer end 124 and a bottom surface 123 opposite a top surface 126. While the bottom surface 123 is preferably flat, the top surface 126 preferably has tapering flanks 129 adjacent side edges 128 with a center groove 125 extending centrally from the inner end 122 to the outer end 124. Indicia 130 and graduations 132 are provided similar to those on the tools 10 of the first embodiment, with the indicia 130 and graduations 132 formed on the flanks 129 of the bar 120.

The alternative tool 110 uniquely typically only includes at least one center hole 140 and preferably a center hole 140 adjacent each end, but no other holes are formed in the bar 120 (other than possibly a suspension hole like the suspension hole 45 of the previous embodiment).

This alternative tool 110 includes a shuttle 150 which can slide along the groove 125. The shuttle 150 is preferably a substantially rigid structure which can be formed of injection molded plastic or metal and otherwise formed to have a geometry such as that depicted in FIGS. 9-14. The shuttle 150 preferably generally includes a plate 152 which conforms to a shape of the top surface 126 of the bar 120. A notch 154 is formed in a side of the plate 152 which extends slightly past one of the side edges 128. This notch 154 can receive the marker M therein (FIG. 9). This notch 154 could be provided in the form of a hole if desired. At ends of the groove 125 stop posts 100 are preferably provided to keep the shuttle from traveling off of the groove 125 ends. The position of the stop posts 100 and the size of the shuttle 150 preferably place the shuttle 150 at a precise point (i.e. the eighteen inch mark for an eighteen inch tool) when the shuttle 150 is against the stop 100.

The shuttle 150 preferably includes a pointer 156 on a side thereof opposite the notch 154 which points at an indicia which identifies a radius that the tool 110 is configured to form when the shuttle 150 is in that position. The shuttle 150 also preferably includes a window 159 strategically located to overlie the indicia 130 so that the indicia 130 can be seen through the window 159 when the shuttle 150 is aligned with one of the indicia 130. This window 159 is preferably aligned with the notch 154 so that when an indicia number appears within the window 159, a mark made through a marker M at the notch 154 will have a distance from a center hole 140 which matches the number within the window 159.

The shuttle 150 includes a bore 158 which preferably receives a lock knob 160 therein as a preferred format selectively engageable shuttle 150 lock. This lock knob 160 is preferably formed of a somewhat resilient material and is adapted to rotate within the bore 158. The lock knob 160 has a cap 162 which overlies the bore 158 and keeps the lock knob 160 from falling down into the bore 158. A grip 163 is provided on top of the cap 162 to assist in gripping and rotating the lock knob 160. A foot 164 extends down from the cap 162 and into the center groove 124. This foot 164 is preferably not radially symmetrical, but rather has a major diameter and a minor diameter which are different from each other. A minor diameter thereof is preferably less than a width of the groove 125. A major diameter of this foot 164 is preferably slightly greater than the width of the groove 125. Because the foot 164 at least is formed of a resilient material, the foot 164 can have an interference fit within the groove 125 to effectively hold the shuttle 150 in position when the lock knob 160 is so rotated (along arrow G of FIGS. 10, 11 and 13).

When the lock knob 160 is rotated to have the minor diameters face the side walls of the center groove 125, preferably a width of the foot 164 is less than that of the center groove 125 to facilitate ready sliding thereof. Most preferably, the foot 164 has a slight taper for both the minor diameter and the major diameter so that the foot 164 always acts to keep the shuttle 160 within the center groove 125 which is preferably also tapered in a dovetail fashion.

While the lock knob 160 is depicted as a rotating element which exhibits a friction fit when rotated to a locking position, other forms of locking knobs or other devices can be provided to secure the shuttle 150 at various different positions along the bar 120. These locking systems can be continuous so that the shuttle 150 can be provided precisely where desired, or can be incrementally positionable at increments which are likely to be desired, such as one-eighth inch increments.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A tool for forming portions of a circle, comprising in combination:

an elongate rigid mass of material extending from a first end to a second end opposite said first end;

a pivot hole adjacent said first end adapted to receive a pivot element therethrough;

a plurality of marking holes spaced from said pivot hole at varying distances from said pivot hole;

said marking holes sized to receive a marking tool passing therethrough;

indicia adjacent said marking holes corresponding to measurement of a distance of said marking holes from said pivot hole;

wherein side edges extend substantially from said first end to said second end, said side edges being straight;

wherein a plurality of graduations are located adjacent at least one of said side edges and extending perpendicularly from said straight side edge adjacent thereto, said graduations located similar distances from each other such that measurement along said side edge is facilitated by said graduations;

wherein each said marking hole has a graduation adjacent thereto, a position of said graduation indicative of a distance from said pivot hole to said marking hole adjacent thereto; and wherein said elongate rigid mass of material includes a contoured top surface including an elongate central groove extending between said first end and said second end, said tool including a shuttle slidably located within said groove, and adapted to slide between said first end and said second end, said shuttle including a marker support thereon.

2. The tool of claim 1 wherein said elongate rigid mass of material includes a substantially flat top surface and a substantially flat bottom surface parallel with said substantially flat top surface, defining said elongate rigid mass with a substantially constant thickness.

3. The tool of claim 2 wherein said plurality of marking holes includes a plurality of primary marking holes located at one inch intervals away from said pivot hole.

4. The tool of claim 3 wherein said plurality of marking holes includes a plurality of secondary marking holes located at one-quarter inch intervals from said pivot hole, other than at said one inch intervals where no secondary marking holes are provided.

5. The tool of claim 4 wherein said plurality of primary marking holes are located along a centerline of said elongate rigid mass and substantially midway between said side edges, said plurality of secondary marking holes located closer to a first side edge than to a second side edge opposite said first side edge; and wherein said plurality of marking holes includes a plurality of tertiary marking holes located at one-eighth inch intervals from each other, other than where said secondary marking holes and said primary marking holes are located, said tertiary marking holes located closer to said second side edge than said primary and said secondary marking holes.

6. The tool of claim 1 wherein said indicia are provided in two sets of integer numerals, one of said sets of indicia counting up from said pivot hole and one of said sets of indicia counting down from said pivot hole, and wherein a second pivot hole is located at said second end opposite said pivot hole adjacent said first end, such that said tool can be utilized with either of said first end or said second end functioning as the pivot hole.

7. The tool of claim 1 wherein a suspension hole is provided adjacent at least one of said ends of said elongate rigid mass of material, said suspension hole larger than said pivot hole and said marking holes and adapted to allow the tool to be suspended from a wall, such as for storage of the tool when not in use.

8. The tool of claim 1 wherein said shuttle includes a lock thereon, said lock adapted to selectively fix said shuttle in a specific location along said elongate rigid mass when said lock is actuated.

9. The tool of claim 8 wherein said lock includes a rotatable locking disk extending into said groove from said shuttle, said groove having a substantially constant width and shape, said lock including a rotatable element formed of resilient material which has at least one dimension narrower than said groove and one dimension wider than said groove, such that said lock exhibits a tolerance fit within said groove in one orientation and a friction fit within said groove in a second orientation, with said lock holding said shuttle in position when said lock is in said second position with an interference fit experienced within said groove.

10. The tool of claim 1 wherein said shuttle includes a window through which portions of said elongate rigid mass are visible, said window positioned to be aligned with said indicia, with said marker support of said shuttle positioned to support a marker at a position located a distance from said pivot hole matching a measurement indicated by said indicia aligned with said window on said shuttle.

11. The tool of claim 1 wherein said top surface includes a pair of tapering flanks on either side of said center groove and extending from said center groove to said side edges, said tapering flanks located opposite a flat bottom forming a side of said tool opposite said tapering flanks, said tapering flanks oriented non-parallel with said bottom surface, said tapering flanks supporting said indicia and said graduations thereon.

12. A method for forming a circular segment in construction of a portion of a structure, the steps including:

identifying a tool having an elongate rigid mass of material extending from a first end to a second end opposite the first end, a pivot hole adjacent the first end adapted to receive a pivot element therethrough, a plurality of marking holes spaced from the pivot hole at varying distances from the pivot hole, the marking holes sized to receive a marking tool and indicia adjacent the marking holes corresponding to measurement of a distance of the marking holes from the pivot hole;

locating a center point for the circular segment;

selecting a radius for the circular segment;

placing the pivot element through the pivot hole;

anchoring the pivot element at the center point;

orienting a marker passing through one of the marking holes corresponding with the radius of said selecting step;

pivoting the tool about the pivot element while marking with the marker; and wherein said identifying step includes the step of identifying the top surface as having a contoured form opposite a substantially planar bottom surface with the top surface having an elongate center groove extending between the first end and the second end of the elongate rigid mass forming the tool, and with a shuttle slidably located within the groove, the shuttle having a marker support structure thereon.

13. The method of claim 12 wherein said identifying step includes the further steps of the tool having side edges extending between the first end and the second end with the side edges being substantially straight, and with graduations adjacent at least one of the side edges and extending perpendicular from the adjacent side edge.

14. The method of claim 12 wherein said identifying step includes the further steps of selecting the tool to have an elongate rigid mass of material including a substantially flat top surface and a substantially flat bottom surface parallel with the substantially flat top surface, defining the elongate rigid mass with a substantially constant thickness;

wherein the plurality of marking holes includes a plurality of primary marking holes located at one inch intervals away from the pivot hole; and wherein the plurality of marking holes includes a plurality of secondary marking holes located at one-quarter inch intervals from the pivot hole, other than at the one inch intervals where no secondary marking hole is provided.

15. The method of claim 12 wherein said identifying step includes identifying the tool as having a rotatable lock extending into the groove from the shuttle, the groove having a substantially constant width and shape, the lock including a rotatable element formed of resilient material which has at least one dimension narrower than the groove and one dimension wider than the groove, such that the lock exhibits a tolerance fit within the groove in one orientation and a friction fit within the groove in a second orientation, with the lock holding the shuttle in position when the lock is in the second position with an interference fit experienced within the groove;

wherein the shuttle includes a window through which portions of the elongate rigid mass are visible, the window positioned to be aligned with the indicia, with the marker support of the shuttle positioned to support a marker at a position located a distance from the pivot hole, matching a measurement indicated by the indicia aligned with the window on the shuttle; and wherein the top surface includes a pair of tapering flanks on either side of the center groove and extending from the center groove to the side edges, the tapering flanks located opposite a flat bottom forming a side of the tool opposite the tapering flanks, the tapering flanks oriented non-parallel with the bottom surface, the tapering flanks supporting the indicia and the graduations thereon.

16. A method for forming a circular segment in construction of a portion of a structure, the steps including:

identifying a tool having an elongate rigid mass of material extending from a first end to a second end opposite the first end, a pivot hole adjacent the first end adapted to receive a pivot element therethrough, a top surface of the tool having a contoured form opposite a substantially planar bottom surface with the top surface having an elongate center groove extending between the first end and the second end of the elongate rigid mass forming the tool, and with a shuttle slidably located within the groove, the shuttle having a marker support structure thereon;

locating a center point for the circular segment;

selecting a radius for the circular segment;

placing the pivot element through the pivot hole;

anchoring the pivot element at the center point;

orienting a marker adjacent the marker support structure;

sliding the shuttle to a position corresponding with the radius of said selecting step; and pivoting the tool about the pivot element while marking with the marker.

17. The method of claim 16 wherein said identifying step includes identifying the tool as having a rotatable lock extending into the groove from the shuttle, the groove having a substantially constant width and shape, the lock including a rotatable element formed of resilient material which has at least one dimension narrower than the groove and one dimension wider than the groove, such that the lock exhibits a tolerance fit within the groove in one orientation and a friction fit within the groove in a second orientation, with the lock holding the shuttle in position when the lock is in the second position with an interference fit experienced within the groove.

18. The method of claim 17 wherein the shuttle includes a window through which portions of the elongate rigid mass are visible, the window positioned to be aligned with indicia located on the top surface, with the marker support of the shuttle positioned to support a marker at a position located a distance from the pivot hole, matching a measurement indicated by the indicia aligned with the window on the shuttle.

19. A tool for forming portions of a circle, comprising in combination:

an elongate rigid mass of material extending from a first end to a second end opposite said first end;

a pivot hole adjacent said first end adapted to receive a pivot element therethrough;

at least one marker support spaced from said pivot hole at varying distances from said pivot hole;

said marker support sized to receive a marking tool adjacent thereto;

indicia corresponding to measurement of a distance of said marker support from said pivot hole;

wherein side edges extend substantially from said first end to said second end, said side edges being straight;

wherein a plurality of graduations are located adjacent at least one of said side edges and extending perpendicularly from said straight side edge adjacent thereto, said graduations located similar distances from each other such that measurement along said side edge is facilitated by said graduations; and wherein said elongate rigid mass of material includes an elongate groove in said top surface extending between said first end and said second end, said tool including a shuttle slidably located within said groove, and adapted to slide between said first end and said second end, said shuttle including said marker support thereon.

20. The tool of claim 19 wherein said shuttle includes a lock thereon, said lock adapted to selectively fix said shuttle in a specific location along said elongate rigid mass when said lock is actuated.

21. The tool of claim 20 wherein said lock includes a rotatable locking disk extending into said groove from said shuttle, said groove having a substantially constant width and shape, said lock including a rotatable element formed of resilient material which has at least one dimension narrower than said groove and one dimension wider than said groove, such that said lock exhibits a tolerance fit within said groove in one orientation and a friction fit within said groove in a second orientation, with said lock holding said shuttle in position when said lock is in said second position with an interference fit experienced within said groove.

22. The tool of claim 19 wherein said shuttle includes a window through which portions of said elongate rigid mass are visible, said window positioned to be aligned with said indicia, with said marker support of said shuttle positioned to support a marker at a position located a distance from said pivot hole matching a measurement indicated by said indicia aligned with said window on said shuttle.

23. The tool of claim 19 wherein said top surface includes a pair of tapering flanks on either side of said center groove and extending from said center groove to said side edges, said tapering flanks located opposite a flat bottom forming a side of said tool opposite said tapering flanks, said tapering flanks oriented non-parallel with said bottom surface, said tapering flanks supporting said indicia and said graduations thereon.

24. A tool for forming portions of a circle, comprising in combination:

an elongate rigid mass of material extending from a first end to a second end opposite said first end;

a pivot hole adjacent said first end adapted to receive a pivot element therethrough;

at least one marker support spaced from said pivot hole at varying distances from said pivot hole;

said marker support sized to receive a marking tool adjacent thereto;

indicia corresponding to measurement of a distance of said marker support from said pivot hole; and wherein said elongate rigid mass of material includes an elongate groove in said top surface extending between said first end and said second end, said tool including a shuttle slidably located within said groove, and adapted to slide between said first end and said second end, said shuttle including said marker support thereon.

25. The tool of claim 24 wherein said shuttle includes a lock thereon, said lock adapted to selectively fix said shuttle in a specific location along said elongate rigid mass when said lock is actuated.

26. The tool of claim 25 wherein said lock includes a rotatable locking disk extending into said groove from said shuttle, said groove having a substantially constant width and shape, said lock including a rotatable element formed of resilient material which has at least one dimension narrower than said groove and one dimension wider than said groove, such that said lock exhibits a tolerance fit within said groove in one orientation and a friction fit within said groove in a second orientation, with said lock holding said shuttle in position when said lock is in said second position with an interference fit experienced within said groove.

27. The tool of claim 24 wherein said shuttle includes a window through which portions of said elongate rigid mass are visible, said window positioned to be aligned with said indicia, with said marker support of said shuttle positioned to support a marker at a position located a distance from said pivot hole matching a measurement indicated by said indicia aligned with said window on said shuttle.

28. The tool of claim 24 wherein side edges extend substantially from said first end to said second end, said side edges being straight.

29. The tool of claim 28 wherein a plurality of graduations are located adjacent at least one of said side edges and extending perpendicularly from said straight side edge adjacent thereto, said graduations located similar distances from each other such that measurement along said side edge is facilitated by said graduations; and wherein said top surface includes a pair of tapering flanks on either side of said center groove and extending from said center groove to said side edges, said tapering flanks located opposite a flat bottom forming a side of said tool opposite said tapering flanks, said tapering flanks oriented non-parallel with said bottom surface, said tapering flanks supporting said indicia and said graduations thereon.

* * * * *